US007084764B2

(12) United States Patent
McHugh et al.

(10) Patent No.: US 7,084,764 B2
(45) Date of Patent: Aug. 1, 2006

(54) SYSTEM AND METHOD FOR MONITORING LOCATION OF AN OBJECT

(75) Inventors: Michael J. McHugh, Dracut, MA (US); Philip A. Eno, Sr., Canterbury, NH (US)

(73) Assignee: Secure Care Products, Inc., Concord, NH (US)

( * ) Notice: Subject to any disclaimer, the term of this patent is extended or adjusted under 35 U.S.C. 154(b) by 112 days.

(21) Appl. No.: 10/824,955

(22) Filed: Apr. 15, 2004

(65) Prior Publication Data

US 2005/0231366 A1 Oct. 20, 2005

(51) Int. Cl.
*G08B 13/12* (2006.01)

(52) U.S. Cl. ..... 340/568.2; 340/572.8; 340/573.4; 340/539.31

(58) Field of Classification Search ..... 340/568.2, 340/572.8, 572.9, 572.1, 573.4, 687, 539.1, 340/539.31

See application file for complete search history.

(56) References Cited

U.S. PATENT DOCUMENTS

| | | | | |
|---|---|---|---|---|
| 5,504,474 | A * | 4/1996 | Libman et al. | 340/573.4 |
| 5,543,780 | A | 8/1996 | McAuley et al. | 340/573 |
| 5,627,520 | A * | 5/1997 | Grubbs et al. | 340/572.1 |
| 5,737,325 | A * | 4/1998 | Fukuda | 370/337 |
| 6,347,229 | B1 | 2/2002 | Zelmanovich et al. | 455/456 |
| 6,693,543 | B1 * | 2/2004 | Stephenson et al. | 340/572.9 |
| 6,853,304 | B1 * | 2/2005 | Reisman et al. | 340/573.4 |
| 2002/0021214 | A1 | 2/2002 | Carroll | 340/540 |

* cited by examiner

*Primary Examiner*—Anh V. La
(74) *Attorney, Agent, or Firm*—Hayes Soloway PC

(57) ABSTRACT

A tag secured to an object for monitoring the object has a strap with a first end, a second end, an electrical path coupled to the strap running from the first end to the second end, and one or more raised portion wherein a proximal end and a distal end of the electrical path are on the one or more raised portions. The first and second end of the strap detachably couple to a cradle. A housing couples to the cradle and holds an integrated circuit with a first contact and second contact wherein the first contact electrically couples to the proximal end of the electrical path and the second contact electrically couples to the distal end of the electrical path.

23 Claims, 12 Drawing Sheets

SYSTEM AND METHOD FOR MONITORING LOCATION OF AN OBJECT

FIELD OF THE INVENTION

The present invention relates generally to monitoring systems, and more particularly to a tag having improved means for ensuring that removal of the monitoring tag is detected and signaled to the monitoring system.

BACKGROUND OF THE INVENTION

Many monitoring systems use a tag secured to the object or individual whose location is to be monitored. The tag transmits periodic radio-frequency signals to a remote monitoring system. The remote monitoring system uses the signals transmitted by the tag to determine the location and current status of the object or individual carrying the tag. When used by an individual, the tag typically is worn on the wrist or ankle.

Some tags use a capacitive coupling to transmit electrical signals through the body of a wearer to monitor whether the tag is being held near the skin of the wearer, or has been removed therefrom. Although this technique is somewhat effective in determining whether the tag is secured to the individual or object being monitored, it suffers from certain disadvantages. For example, some individuals suffering from mental illness or senile dementias, and some children, have a fear of electrical energy and are terrified of having electrical energy transmitted through their bodies. Such individuals usually will not consent to wearing the tag and may become violent and/or agitated if they are forced to wear it, and/or will remove the tag when they are left unattended. Additionally, transmission of electrical energy through certain types of magnetic recording media (e.g., magnetic tape, disks, etc.) can damage or destroy the information stored on the media. This renders the capacitive monitoring tag, generally undesirable for use in monitoring the location of such media.

Other tags are held in place near the skin of the wearer by a conductive strap that wraps around the wrist or ankle of the wearer. An electrical signal is passed through the conductive strap to periodically determine whether the strap has been broken. The periodic signals transmitted by the tag permit the monitoring system to determine whether the person being monitored is within the area being monitored.

Both of the above tags rely on a portable power source, such as batteries, to power electronics of the tag. The relatively short life cycle of batteries often require the batteries of the tag to be continually replaced. In addition, some facilities are continually checking-in and checking-out individuals or items. There is a need for a tag that can be easily secured and unsecured to an individual or item while preventing an unauthorized person from removing the tag.

Thus, a heretofore unaddressed need exists in the industry to address the aforementioned deficiencies and inadequacies.

SUMMARY OF THE INVENTION

In one aspect, the invention features a tag secured to an object for monitoring the object having a strap with a first end, a second end, an electrical path coupled to the strap running from the first end to the second end, and one or more raised portions wherein a proximal end and a distal end of the electrical path are in communication with the one or more raised portions. The tag also has a cradle that detachably couples the first end of the strap to the cradle and detachably couples the second end to the cradle. An integrated circuit has a first contact and second contact wherein the first contact electrically couples to the proximal end of the electrical path and the second contact electrically couples to the distal end of the electrical path.

In another aspect, the tag secured to an object features an integrated circuit electrically coupled to a first end of the electrical path and a second end of the electrical path wherein the integrated circuit monitors one or more electrical properties of the electrical path. The tag also features a transmitter electrically coupled to the integrated circuit and the electrical path wherein the transmitter radiates a radio wave through the electrical path when the one or more electrical properties change.

In yet another aspect, the tag secured to an object features an object proximity detector, a motion sensor, and a transmitter in communication with a monitoring system. An integrated circuit is in communication with the object proximity detector, the transmitter, and the motion sensor. The integrated circuit signals the monitoring system via the transmitter when the object proximity detector is separated from the object. The integrated circuit increases power consumption of the tag for a period of time when the motion sensor detects motion.

Other features and advantages of the present invention will be or become apparent to one with skill in the art upon examination of the following drawings and detailed description. It is intended that all such additional features and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
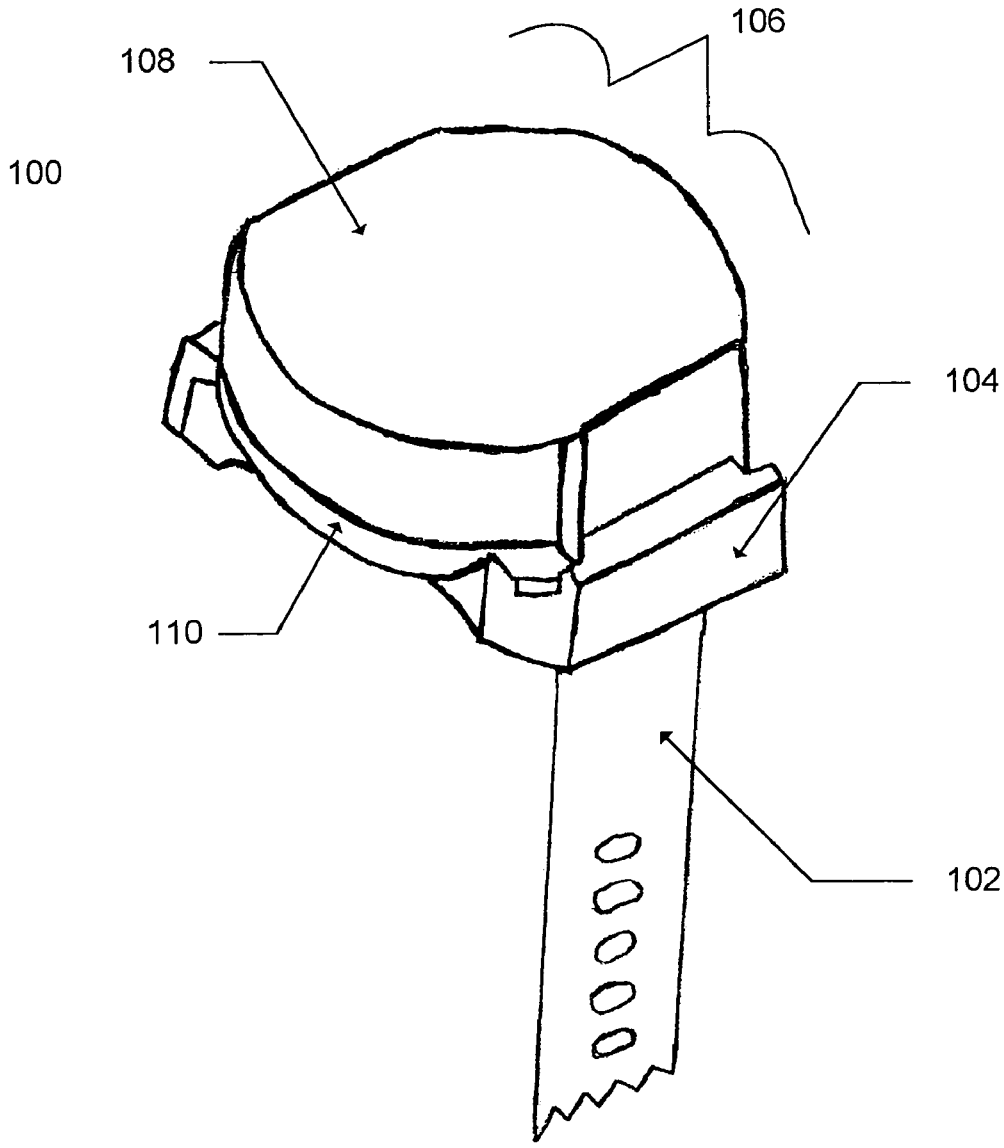
FIG. 1 is a top perspective view of the monitoring tag, in accordance with a first exemplary embodiment of the invention.

FIG. 1 is a top perspective view of a monitoring tag 100, in accordance with a first exemplary embodiment. The monitoring tag 100 is typically worn on an extremity of an individual. The monitoring tag 100 transmits a signal to components of a remote monitoring system. Each monitoring tag 100 broadcasts a unique identification signal. The identification signal is broadcasted by transmitting a wireless signal, for example but not limited to, a radio frequency (RF). A network of monitoring devices and sensors transmits information back to a monitoring station. The monitoring station receives the unique identification signal and associates the unique signal with information about the item or person wearing the monitoring tag 100. The monitoring station can then alert staff members of a facility based on the information from the monitoring components and predetermined procedures. An example of such a monitoring station is described in the pending patent application having Ser. No. 10/768,300 by Ciarcia et al., having been filed Jan. 30, 2004, the disclosure of which is hereby incorporated in its entirety.

Most of the examples described herein are associated with a person wearing the monitoring tag 100, however, it should be apparent that the various embodiments associated with the monitoring tag 100 can also be employed with the monitoring tag 100 connected to items and used to track the movement of items throughout a facility. For example, radioactive material in a hospital can be stored within a container that also has the monitoring tag 100 connected to the container. The monitoring station and monitoring tag 100 would allow hospital staff to track the location of the material within the facility.

In addition to transmitting an identification signal, the monitoring tag 100 can also transmit an alert signal. The alert signal is broadcasted by transmitting a wireless signal, for example but not limited to, radio frequency (RF) signal. The wireless signal indicates that a problem has occurred with the monitoring tag 100. For example, the individual may have attempted to remove the monitoring tag 100 from their body. This would activate the alert signal that would communicate a possible problem to the monitoring station. The alert signal broadcasts when the monitoring tag 100 detects a problem, in contrast to the identification signal that is periodically broadcasted by the monitoring tag 100 on a continuous basis. The monitoring tag 100 can broadcast a more powerful alert signal without depleting power resources of the monitoring tag 100, such as a battery.

Figure 6:
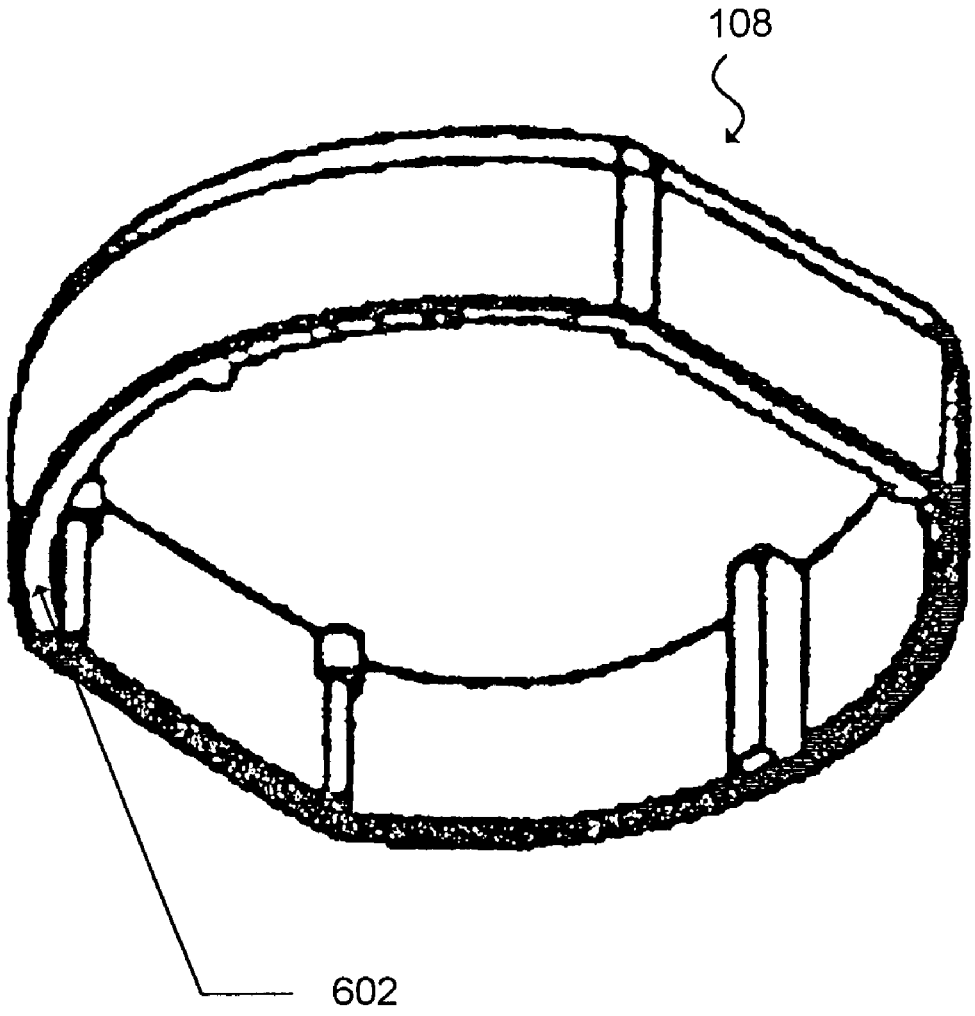
FIG. 6 is a perspective view of the housing base, in accordance with the first exemplary embodiment of the invention.
Figure 7:
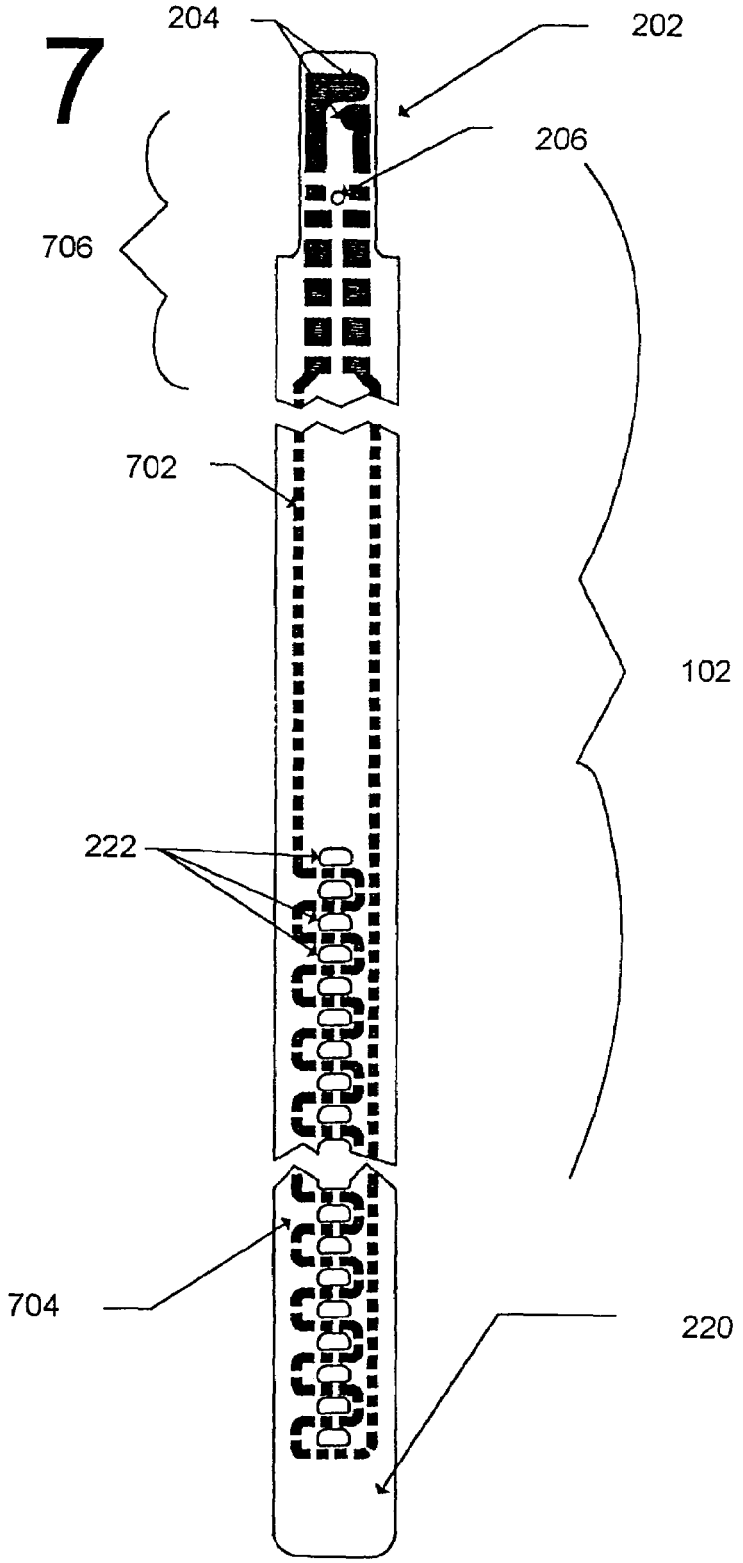
FIG. 7 is a top plane view of the strap, in accordance with the first exemplary embodiment of the invention.

The monitoring tag 100 as shown in FIG. 1 has a strap 102 that wraps around an extremity of an individual, for example but not limited to, the wrist or ankle of the individual. The strap 102 couples at two locations to a cradle 104 of the monitoring tag 100. The cradle 104 of the monitoring tag 100 couples the strap 102 to a housing 106 of the monitoring tag 100. The housing 106 has a housing base 108 and a housing cover 110 that hold the interior components 1100 (shown in FIG. 11) of the monitoring tag 100. The housing base 108 and housing cover 110 are described and shown in greater detail in the specification associated with FIGS. 4–6. The strap 102 of the monitoring tag 100 has an electrical path 702 (as shown in FIG. 7) within the strap 102. The electrical path 702 (FIG. 7) is electrically coupled to the interior components 1100 (FIG. 11) of the monitoring tag 100. The interior components 1100 (FIG. 11) monitor the electrical properties of the electrical path 702 (FIG. 7). A change in the electrical properties of the electrical path 702 (FIG. 7) is used to indicate that integrity of the strap 102 may have been jeopardized. For example, the individual wearing the monitoring tag 100 may have attempted to break the strap 102 or stretch the strap 102 in an unauthorized attempt to remove the monitoring tag 100. The strap 102 is described and shown in greater detail in the specification associated with FIGS. 7–9. The interior components 1100 (FIG. 11) relay an alert signal to the components of the monitoring station. The monitoring station can be designed to sound an alarm or lock exit points based on the received alert signal. The interior components 1100 (FIG. 11) are described in greater detail in the specification associated with FIGS. 11 and 12.

Figure 2:
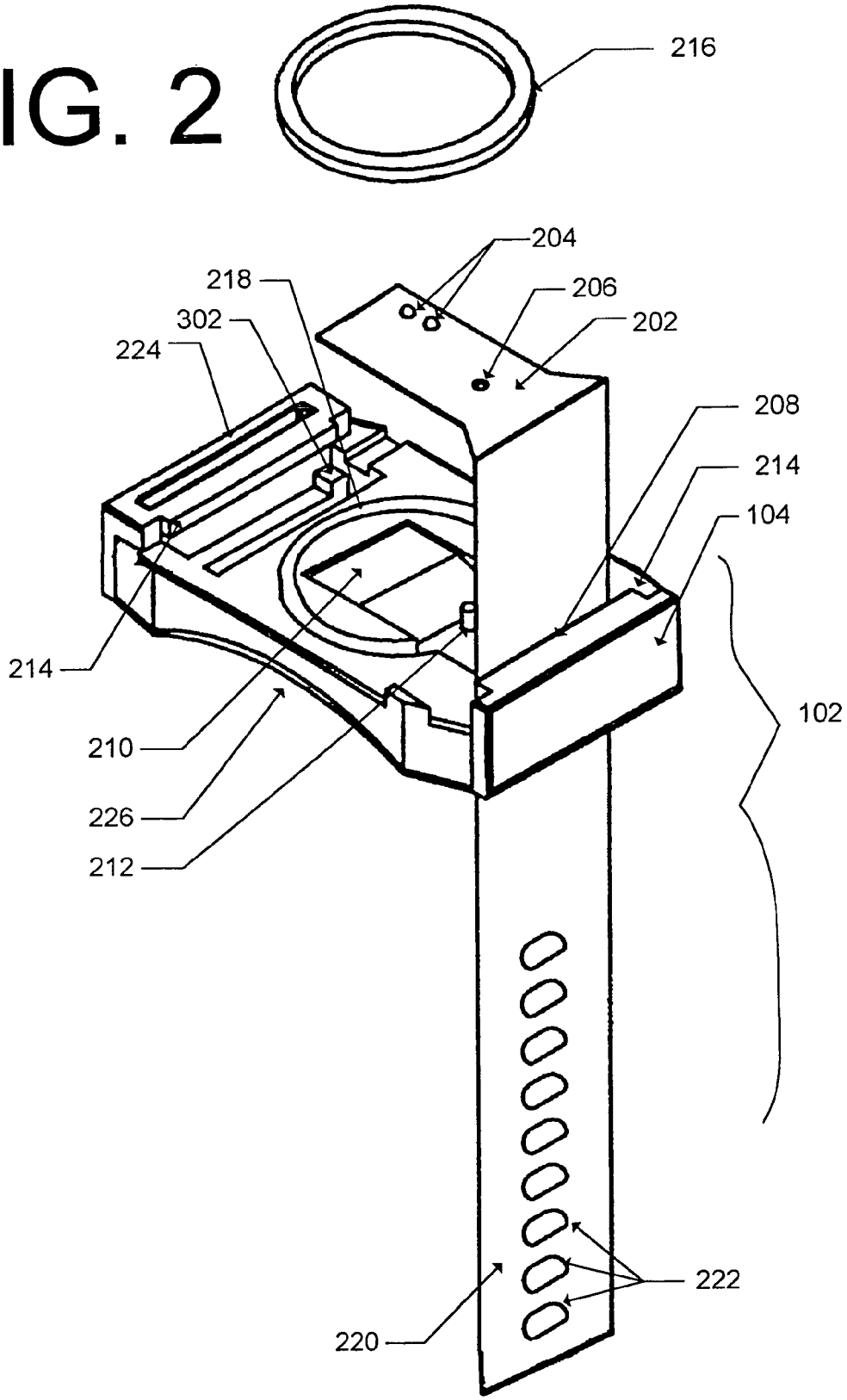
FIG. 2 is a top, right perspective view of the cradle and strap, in accordance with the first exemplary embodiment of the invention.
Figure 3:
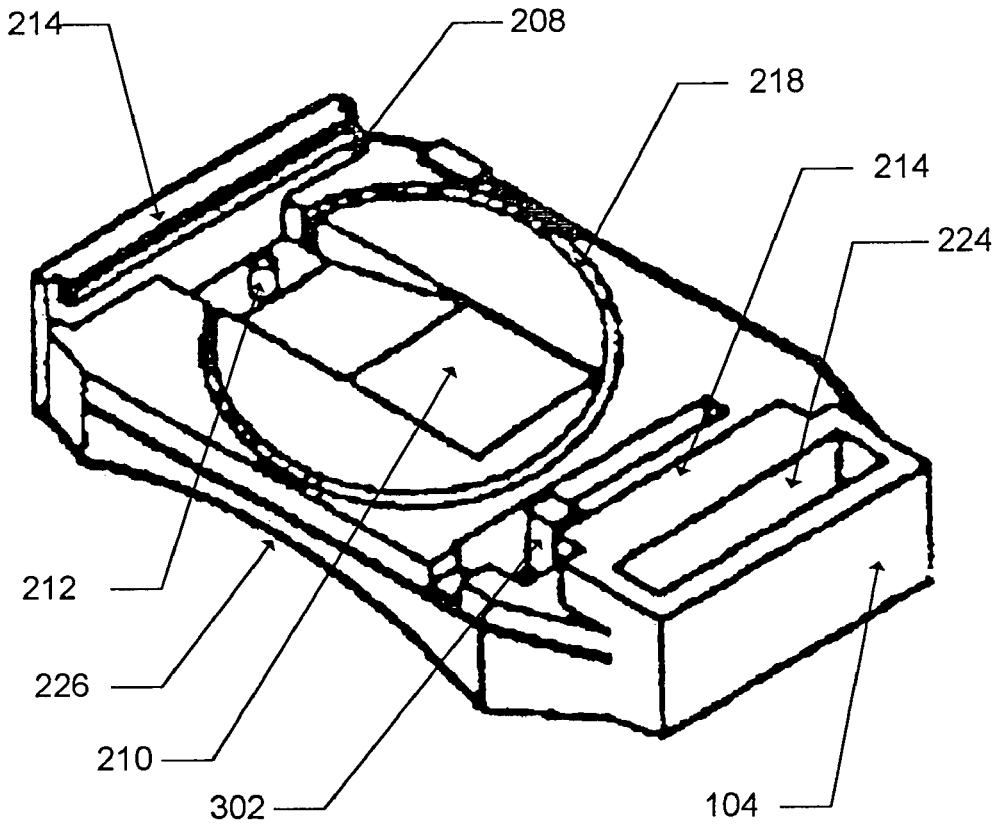
FIG. 3 is a top, left perspective view of the cradle of FIG. 2.
Figure 4:
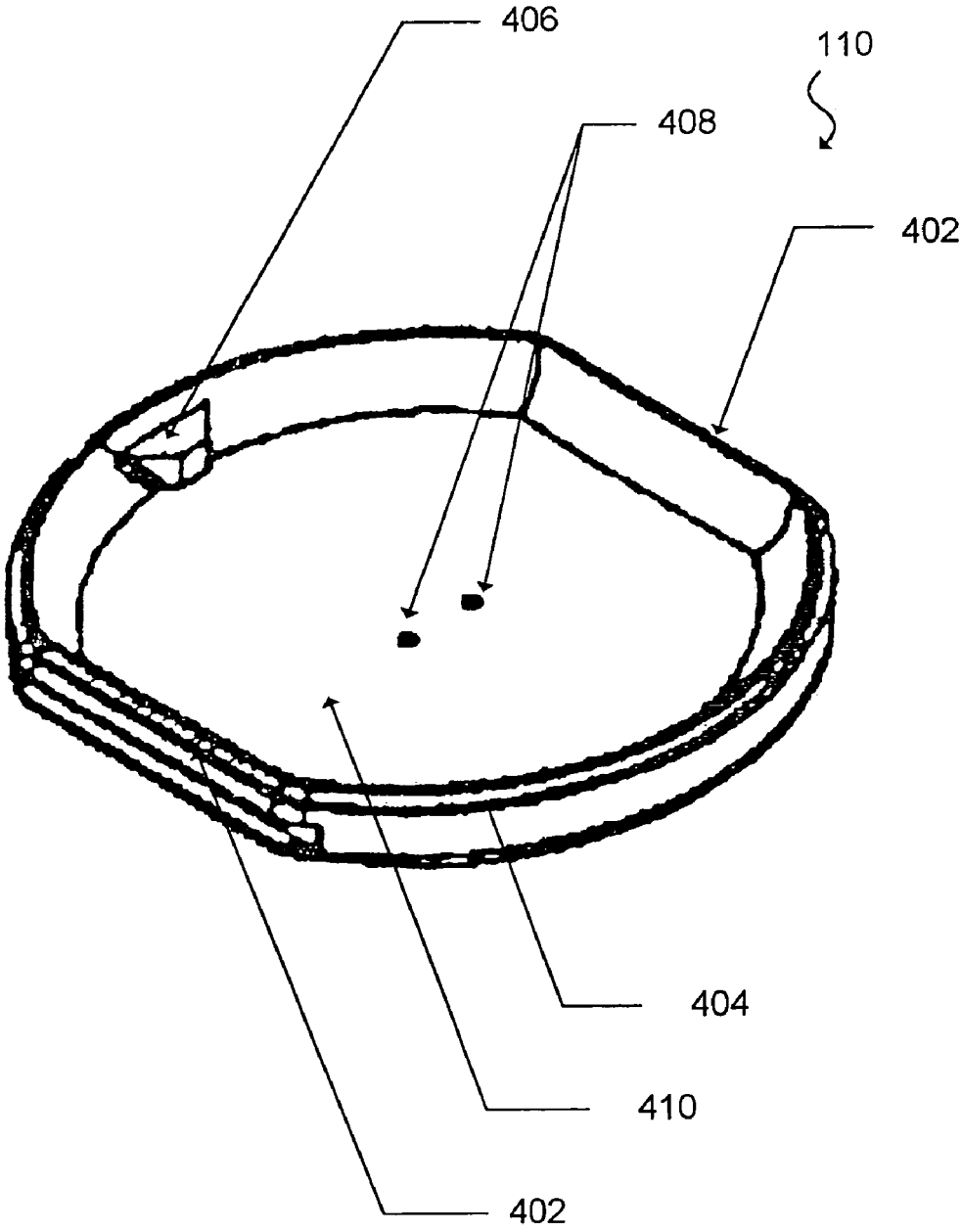
FIG. 4 is a top perspective view of the housing cover, in accordance with the first exemplary embodiment of the invention.
Figure 5:
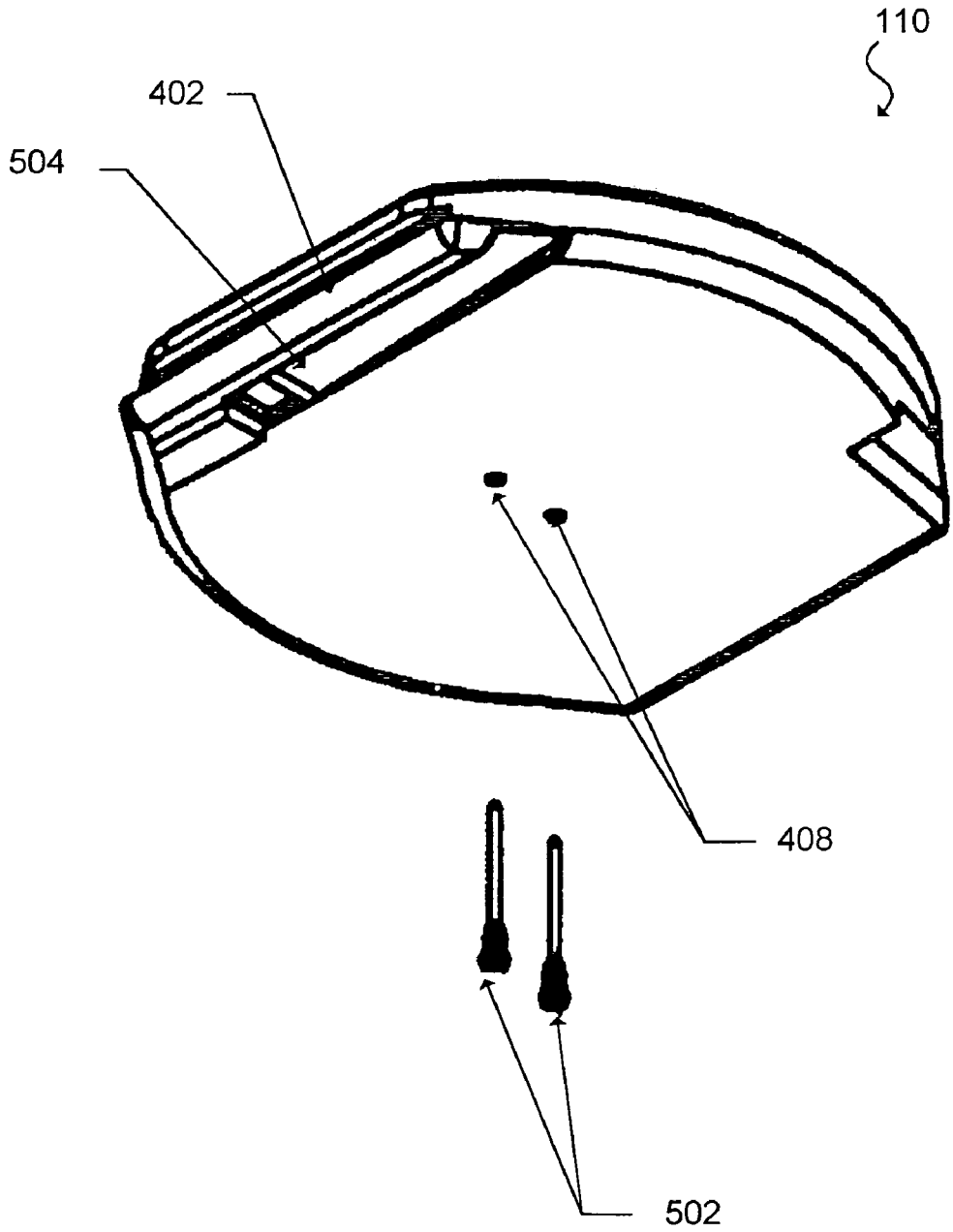
FIG. 5 is a bottom perspective view of the housing cover with contact leads, in accordance with the first exemplary embodiment of the invention.
Figure 11:
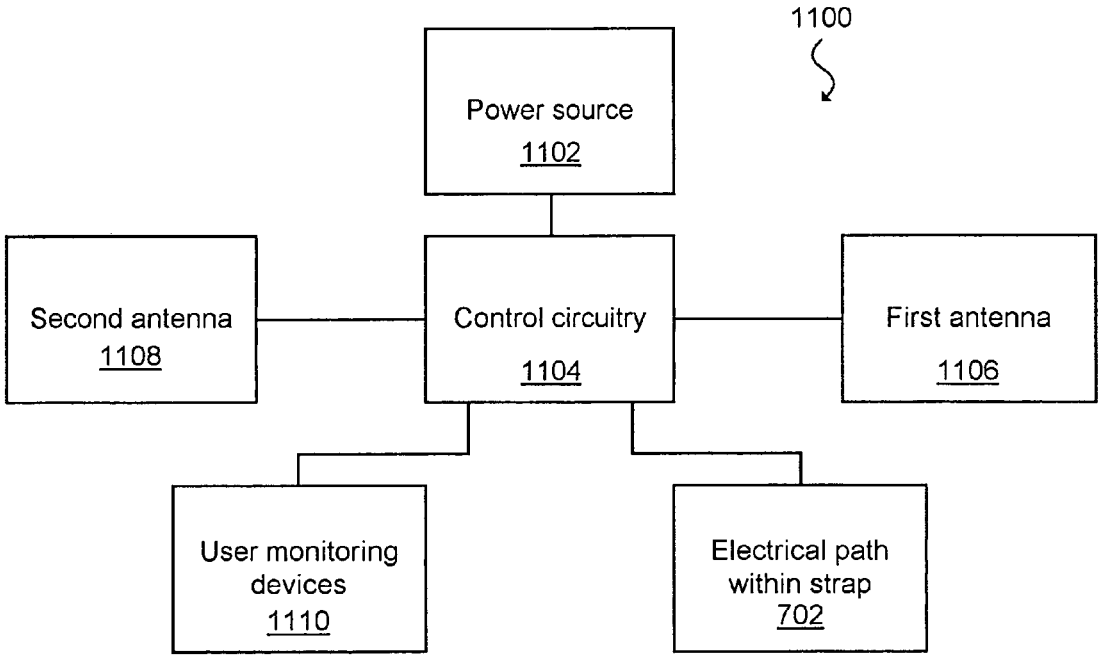
FIG. 11 is a block diagram illustrating interaction of the interior components of the monitoring tag of FIG. 1, in accordance with the first exemplary embodiment of the interior components.

FIG. 2 is a top perspective view of the cradle 104 and strap 102, in accordance with the first exemplary embodiment of the invention. FIG. 3 is a top, left perspective view of the cradle 104 of FIG. 2 without the strap 102. The strap 102 has a first end 202 with two electrical path contacts 204 and an alignment opening 206 to hold the first end 202 of the strap 102 in place during coupling of the housing 106 to the cradle 104. The first end 202 of the strap 102 is threaded through a first opening 208 in the cradle 104. The first end 202 of the strap 102 is then positioned within a recessed portion 210 of the cradle 104. An alignment opening 206 in the strap 102 is fitted over a stud 212 located within the recessed portion 210. The stud 212 and alignment opening 206 hold the first end 202 of the strap 102 in place while the housing cover 110 is attached to the cradle 104 over the first end 202 of the strap 102. The housing cover 110 has two lips 402 (as shown in FIGS. 4 and 5) on the side edges of the housing cover 110. The two lips 402 (FIG. 4) of the housing cover 110 are positioned within two grooves 214 located on the peripheral edges of the cradle 104. The housing cover 110 slides from the side of the cradle 104 into a position centered on the cradle 104 as shown in FIG. 1. A ratchet 302 holds the housing cover 110 in place on the cradle 104. The housing cover 110 of the housing 106 sandwiches the first end 202 of the strap 102 between the cradle 104. Two electrical posts 502 (as shown in FIG. 5) protruding from the housing cover 110 align with the two electrical contacts 204 on the strap 102. When the cradle 104 is in place, the electrical posts 502 (FIG. 5) of the housing cover 110 impact the electrical contacts 204 of the strap 102 providing an electrical connection between the electrical path 702 (FIG. 7) of the strap 102 and the interior components 1100 (FIG. 11). The stud 212 of the cradle 104 prevents the strap 102 from being removed from the cradle 104 when the housing 106 is attached. In addition to the stud 212, a bottom surface of a plastic layer 908 (FIG. 9) on the first end 202 of the strap 102 may have an adhesive surface that adheres to the surface of the recessed portion 210 of the cradle 104. The adhesive surface may have a protective cover, which is pealed off prior to installation. The adhesive surface of the strap 102 is pressed against the surface of the recessed portion 210 of the cradle 104. A washer 216 can be inserted between the strap 102 and housing cover 110 to prevent fluids from disturbing the electrical connection between the electrical posts 502 (FIG. 5) of the housing cover 110 and the electrical contacts 204 of the strap 102. A recessed groove 218 on the surface of the cradle can be used to hold the washer 216 in place when coupling the housing cover 110 to the cradle 104. The housing cover 110 and the cradle 104 sandwich the washer 216, providing a light compressive force on the washer 216 so as to prevent liquid, i.e. water or bodily fluid, from contacting the electrical connection between the electrical posts 502 and the electrical contacts 204.

A second end 220 of the strap 102 has one or more ratchet d-shaped openings 222 located lengthwise along the strap 102. The second end 220 of the strap 102 is fed into a second opening 224 located on the opposing edge of the cradle 104 adjacent from the first opening 208. Within the second opening 224 is a cinching mechanism (not shown) that grasps the flat side of the one or more ratchet d-shaped openings 222 of the strap 102. When the second end 220 of the strap 102 is inserted within the second opening 224, ratchets of the cinching mechanism grip the ratchet openings 222 located lengthwise on the strap 102. The cinching mechanism allows the strap 102 to be inserted within the second opening 224 but prevents the strap 102 from being pulled backwards through the second opening 224 of the cradle 104. A staff member attaches the monitor tag 100 to a wrist of an individual by wrapping the strap 102 around the wrist of the individual and feeding the second end 220 of the strap 102 through the second opening 224 of the cradle 104. A bottom portion 226 of the cradle 104 rests against the wrist of the individual and can be contoured to the curved shape of a typical wrist. The staff member then pulls the second end 220 of the strap 102 so that the monitoring tag 100 is securely attached to the wrist of the individual. The strap 102 should be tightened sufficiently to prevent the strap 102 from sliding over the wrist and hand of the individual without providing discomfort to the individual. The second end 220 of the strap 102 can also have an adhesive on a bottom surface of the plastic layer 908 (FIG. 9) of the strap 102 with a protective cover that is removed prior to installation. The adhesive surface allows the second end 220 of the strap 102, to be secured to the monitoring tag 100. Securing the excess portion (i.e. the portion of the second end that extends beyond the second opening) of the second end 220 of the strap 102, prevents the excess portion of the strap 102 from flapping around and annoying the individual while also not necessitating the staff to cut the excess portion and possibly disturb the electrical path 702 within the strap 102.

The coupling of the strap 102 to the cradle 104 and the housing 106 allows an administrator to adjust the length of the strap 102 without necessitating the replacement of the strap 102. For example, a newborn infant can lose approximately 20–30% of their body weight during the first 24 hours of life. Due to this weight loss, the strap 102 may need to be adjusted to the current size of the wrist or ankle of the infant to prevent unauthorized removal. The coupling of the strap 102 to the cradle 110 and the housing 106 allows the strap 102 length to be adjusted without removal of the strap 102.

FIG. 4 is a top perspective view and FIG. 5 is a bottom perspective view of the housing cover 110, in accordance with the first exemplary embodiment of the invention. In addition, FIG. 6 is a bottom perspective view of the housing base 108. The cradle 104, housing base 108, and housing cover 110 can be made of a molding plastic. However, a variety of materials can be used to construct the cradle 104, housing base 108, and housing cover 110, for example but not limited to, metals, plastics, ceramics, and composites. The cradle 104, housing base 108, and housing cover 110 are designed to be lightweight and unobtrusive to the individual wearing the monitoring tag 100. A variety of techniques can be employed to accomplish these objectives, for example but not limited to, using lightweight material and removing unnecessary material.

The interior components 1100 (FIG. 11) are mounted within the housing base 108. A bottom edge 602 of the housing base 108 (shown in FIG. 6.) can be press-fitted to a rim 404 of the housing cover 110 (shown in FIG. 4) forming a watertight seal. In addition to press-fitting the housing cover 110 and housing base 108, a variety of other methods can be used to secure the housing cover 110 to the housing base 108, for example but not limited to, glue or ultrasonic weld. A key 406 can also be used on the housing cover 110 to ensure proper placement and fitting on the housing base 108. The key can also be used to ensure proper antenna alignment relative to the individual wearing the tag 100. Proper alignment of the antenna provides a more predictable transmission by the antenna.

Two electrical post openings 408 on a bottom surface 410 of the housing cover 110 allow for the two electrical posts 502 to be inserted therein. The electrical posts 502 can be press-fitted within the two electrical post openings 408 forming a water tight seal. An adhesive can also be used to secure them within the two electrical post openings 408. The electrical posts 502 extend through the electrical post openings 408 and make electrical contact to the interior components 1100 (FIG. 11) of the monitoring tag 100. The assembled housing 106 with interior components 1100 (FIG. 11) can then be coupled to the cradle 104 as previously discussed. The two lips 402 on the side edges of the housing cover 110 are positioned within two groves 214 located on the peripheral edges of the cradle 104. The housing 106 is slid from the side of the cradle 104 into a position centered on the cradle 104 as shown in FIG. 1. The ratchet 302 on the bottom surface of the cradle 104 (as shown in FIG. 3) allows the housing cover 110 to slide into position but prevents the cradle 104 from accidentally sliding out of the grooves 214 on the cradle 104.

Figure 8:
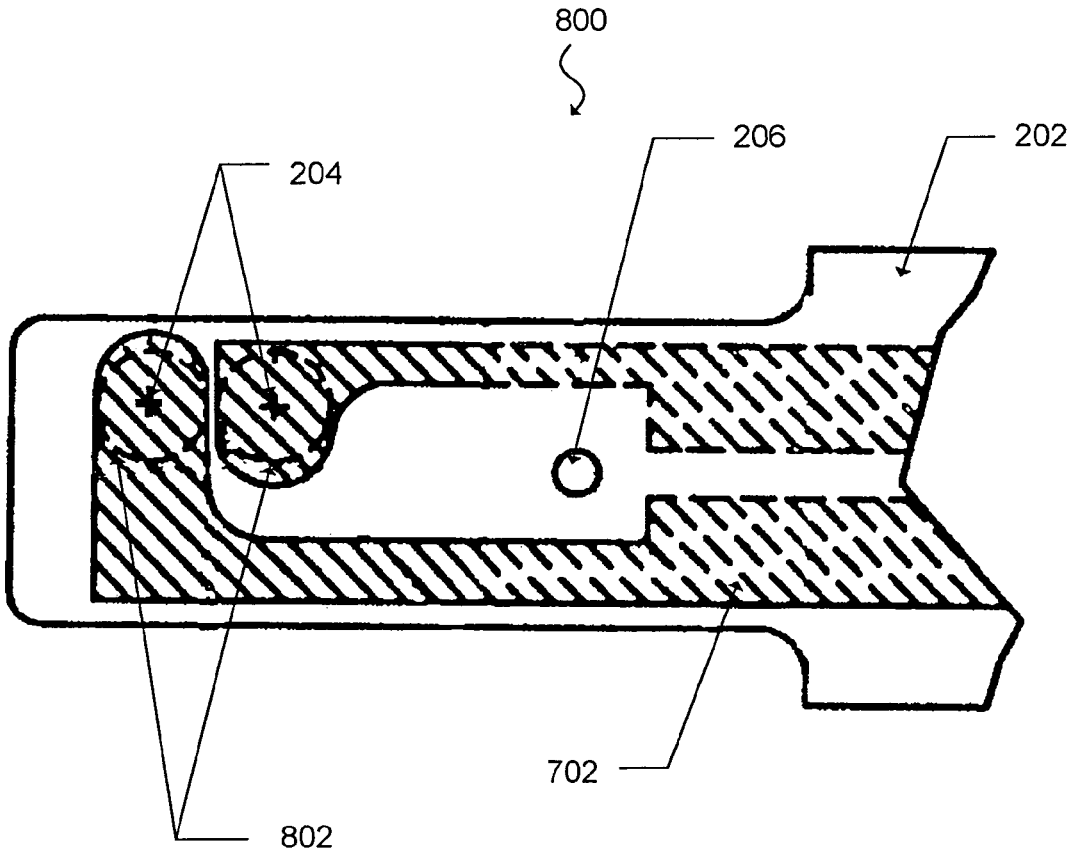
FIG. 8 is a top plane view of the first portion of the strap, in accordance with the first exemplary embodiment of the invention.
Figure 9:
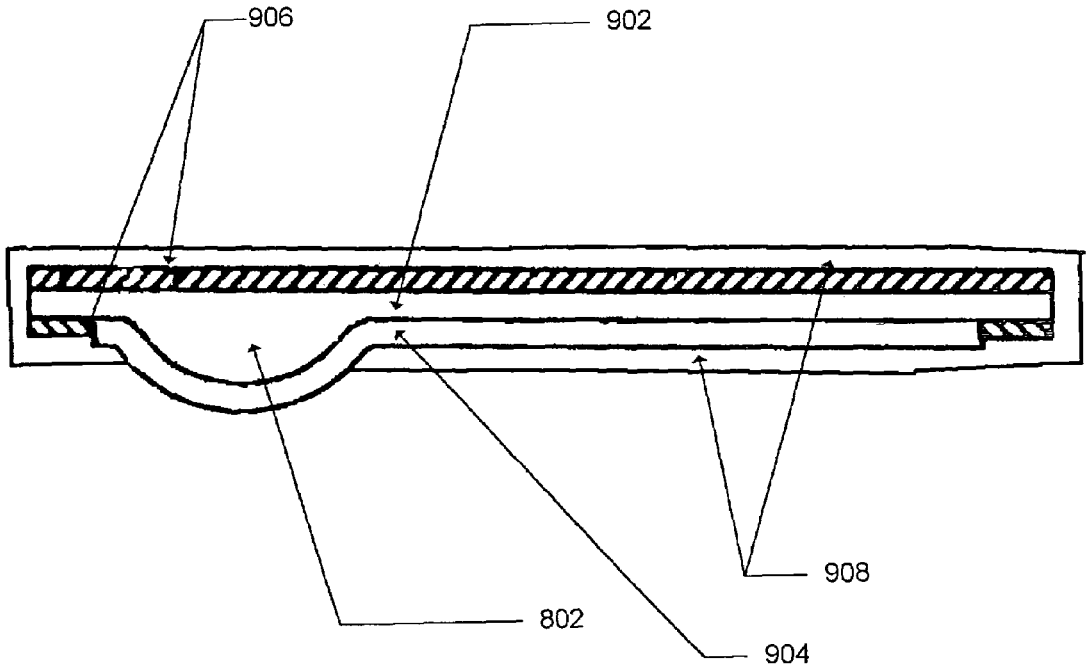
FIG. 9 is a front, profile view of the contact portion of the strap, in accordance with the first exemplary embodiment of the invention.

FIG. 7 is a top view of the strap 102, in accordance with the first exemplary embodiment of the invention. FIG. 8 is a top view and FIG. 9 is a front, profile view of a contact portion 800 of the first end 202 of the strap 102. The length of the strap 102 designed for use by infants ranges from about 6 inches to 3 inches. The length of the strap 102 designed for use by adults ranges from about 4½ inches to 12 inches. The length of the strap 102 can be designed for coupling to various other extremities of people or objects. The width of the strap 102 is about a ½ inch. One method of strap 102 construction utilizes a polyester layer 902. If course, other material may be utilized. Two domes 802 are pressed at the location of the electrical contacts 204 on the polyester layer 602. The domes 802 have a radius of about 0.067 inches and a height of about 0.01 inches. They are spaced about 0.016 inches apart with distance of about 0.150 between the centers of the two domes 802. A flexible conductive ink layer 904 is imprinted on the polyester layer 902 to produce the electrical path 702. A layer of adhesive 906 is applied to the top and bottom surfaces of the polyester layer 902. A layer of plastic 908 is applied to the top and bottom adhesive layers 906 covering the entire surface of the polyester layer 902 except on the top surface of the two domes 802 where the conductive ink layer 904 is left exposed. The strap 102 is then cut to shape. The above described strap 102 construction is an illustrative example.

Many variations in the construction and size are possible.

The electrical path 702 traces out a path on the strap 102 so as to break the electrical conductivity of the electrical path 702 when someone attempts to remove the monitoring tag 100. The electrical path 702 zigzags around the ratchet openings 222 and along the perimeter of the strap 102 (as shown in FIG. 7). If someone attempts to cut the strap 102 the conductivity of the electrical path 702 would be disrupted. In addition, if someone attempts to pull the second end 220 of the strap 102 from the ratcheting mechanism a zigzag portion 704 of the electrical path 702 would break. Additionally, if someone attempts to pull the first end 202 of the strap 102 from the cradle 104, the conductivity of the electrical path 702 would also be broken. The pattern of the electrical path 702 is not limited to the electrical path 702 shown in FIG. 7. A variety of other patterns can be used to prevent breaking or stretching the strap without changing the electrical properties of the electrical path 702.

The electrical path 702 can also be designed to have a greater thickness at high stress locations on the strap 102. For example, high stress portions 706 of the strap 102 that make contact with the cradle 104 are often the points of greatest stress on the strap during routine use of the monitoring tag 100. To prevent accidentally breaking the electrical path 702 due to normal wear, the thickness of the electrical path 702 can be increased.

In addition to designing the strap 102 to prevent accidental breaking, the strap 102 can also be designed to have a breakpoint. The strap 102 can be perforated or notched at a predetermined location on the strap 102 to facilitate breaking at the predetermined point and under a predetermined amount of stress. The breakpoint can be used to prevent injury to the individual wearing the monitoring tag 100 when an attempt is made to remove the monitoring tag 100. For example, the strap 102 can be designed not to injure an infant when a person attempts to rip the monitoring tag 100 off the wrist of the infant. Instead the strap 102 would break at the predetermined breakpoint, thus breaking the electrical path 702 and notifying the monitoring system that the monitoring tag 100 has been removed without injury to the wrist of the infant.

Figure 10:
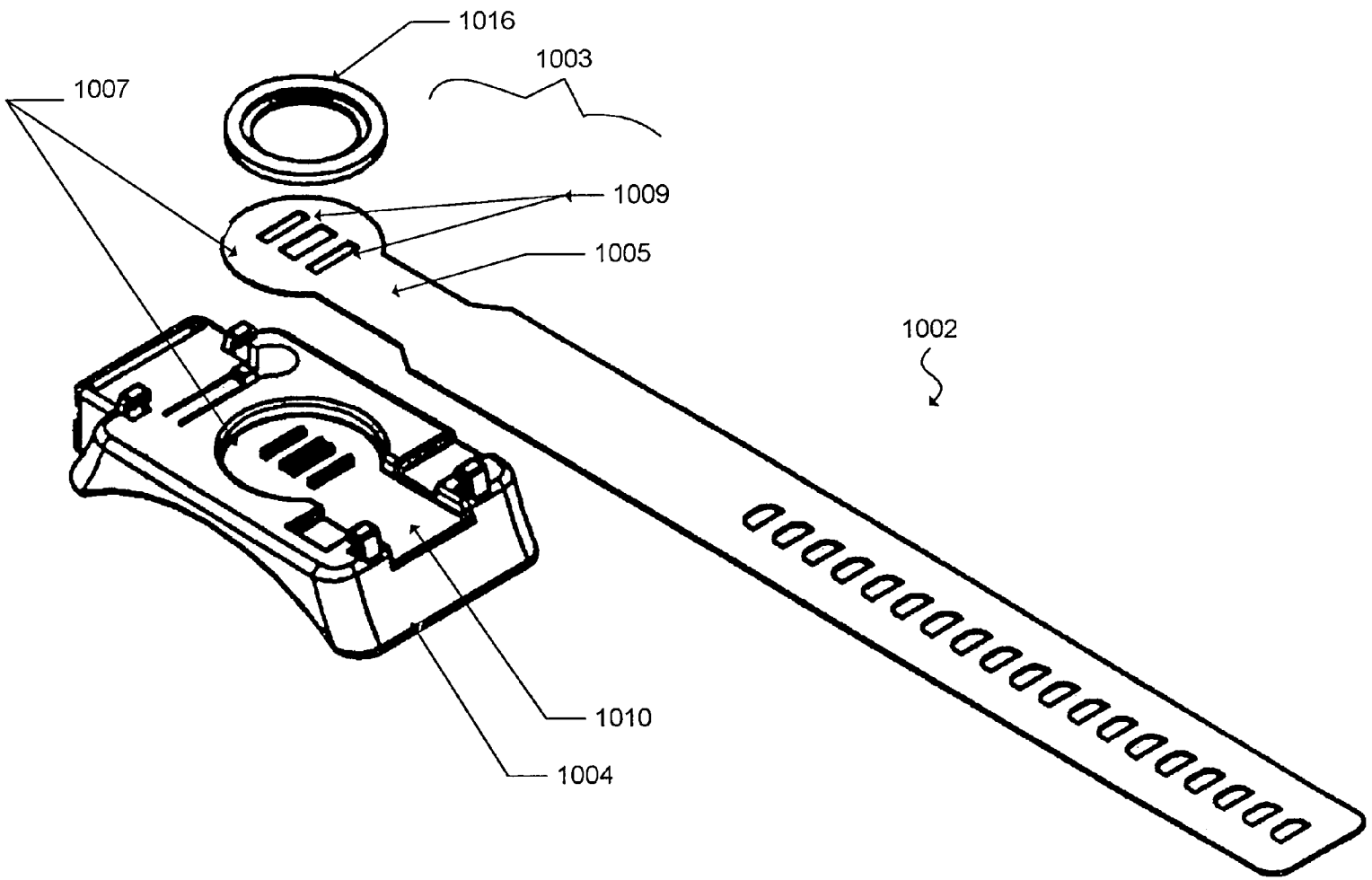
FIG. 10 is a perspective view of the cradle and strap, in accordance with the second exemplary embodiment of the invention.

FIG. 10 is a top perspective view of the cradle 1004 and strap 1002, in accordance with the second exemplary embodiment of the invention. The strap 1002, in accordance with the second exemplary embodiment, has a first portion 1003 with a different profile. The profile of the first portion 1003 is designed to prevent the first portion 1003 from being removed from the cradle 1004. A recessed portion 1010 and the first end 1003 of the strap 1002 have a proximal portion 1005 and a distal portion 1007. The proximal portion 1005 is designed to be narrower than the distal portion 1007. The profile of the strap 1002 and the recessed portion 1010 prevent the first end 1003 of the strap 1002 from being removed from the cradle 1004 when the housing 106 is attached to the cradle 1004. Similar to the first exemplary embodiment, when the cradle 1004 is in place, the electrical posts 502 of the housing cover 110 impact the electrical contact 1009 of the strap providing an electrical connection between the electrical path 702 of the strap 1002 and the interior components 1100 (FIG. 11). A washer 1016 can be inserted between the strap 1002 and housing cover 110 to prevent fluids from damaging the electrical connection between the electrical contacts 1009 of the strap 1002 and the electrical posts 502 of the housing cover 110. The designs of the first and second exemplary embodiment are illustrative examples of monitoring tags 100 that can be constructed. The straps 102, 1002 and cradle 104, 1004 of the monitoring tag 100 can be designed to incorporate any one of a number of elements shown in both exemplary embodiments.

FIG. 11 is a block diagram illustrating the interaction of the interior components 1100 of the monitoring tag 100 of FIG. 1, in accordance with the first exemplary embodiment of the interior components 1100. The interior components 1100 are powered by a power source 1102 located within the housing 106. The power source 1102 can be a battery or other portable power supply. Control circuitry 1104 coordinates the function of the monitoring tag 100. The control circuitry 1104 monitors the electrical properties of the electrical path 702 in the strap 102 of the monitoring tag 100. When the control circuitry 1104 determines that the electrical properties of the electrical path 702 have changed, the control circuitry 1104 emits an alert signal that is transmitted wirelessly to the monitoring system via the first antenna 1106. The first antenna 1106, for example, can be a 13.56 megahertz (MHZ) coil antenna. The monitoring station can be designed to sense a variety of changes in the electrical path 702, for example but not limited to, the resistance, the capacitance, or the inductance of the electrical path 702. In addition to emitting the alert signal, the control circuitry 1104 also emits an identification signal. The monitoring station receives the unique identification signal and associates the unique signal with information about the individual wearing the specific monitoring tag 100. The monitoring station can then alert staff members of a facility based on the information from the monitoring components and predetermined procedures. For example, the monitoring station can be designed to lock an exit door when the individual wearing a monitoring tag 100 approaches the exit door. The control circuitry 1104 can be designed to continuously or periodically broadcast the identification signal via a second antenna 1108. The second antenna 1108, for example, can be a 418/433.92 MHZ strip antenna.

The control circuitry 1104 may be implemented entirely in hardware or in software and hardware. The control circuitry 1104 can be implemented with one or a combination of the following technologies, which are each well known in the art: a discrete logic circuit(s) having logic gates for implementing logic functions upon data signals; an application-specific integrated circuit (ASIC) having appropriate combinational logic gates; a programmable gate array(s) (PGA); a field programmable gate array (FPGA); etc. In an alternative embodiment (not shown), the control circuitry 1104 can be implemented via software on a general processor. The control circuitry 1104 may have a storage device. The storage device may be any nonvolatile memory element (e.g., ROM, hard drive, etc.).

In addition to the first antenna 1106 and second antenna 1108, the control circuitry 1104 can also use the electrical path 702 as an external antenna. The electrical path 702 provides a longer antenna that is external to the housing 106. The antenna leads of the control circuitry 1104 of the first antenna 1106 can also be coupled to the electrical path 702 using a capacitor. When the strap 102 is broken, the control circuitry 1104 broadcasts the alert signal to both the first antenna 1106 and the electrical path 702. The electrical path 702 provides an antenna with increased transmission capabilities, thus increasing the strength and distance of wireless transmission.

Typically, the length of an antenna is equal to a fraction of the wavelength being transmitted, i.e. ½, ⅝, ¼ and ⅛ of the wavelength. The length of the electrical path 702 can be designed to be equal to an optimal transmission length based on the wavelength of the alert signal. In addition to designing the length of the electrical path 702 to be equal to an optimal length, the breakpoint of the strap 102 can also be designed to break the electrical path 702 at a corresponding optimal point. Using the electrical path 702 provides the control circuitry 1104 with a more powerful antenna during critical transmission stages. By using the electrical path 702 as an antenna, the monitoring tag 100 can decrease the chances of the monitoring station not receiving the alert signal wireless transmission.

The monitoring tag 100 can also incorporate other monitoring devices 1110 to monitor individuals wearing the monitoring tag 100. For example, the monitoring tag 100 can incorporate a heart rate monitor. The heart rate monitor can be used to detect the pulse of the individual wearing the monitoring tag 100. The control circuitry 1104 can incorporate the pulse information of the individual in the identification signal. In another design of the monitoring tag 100, the control circuitry 1104 can be designed to send an alert signal when the pulse rate deviates from the normal pulse rate stored within the monitoring tag 100. Other monitoring devices can also be incorporated in the monitoring tag and are within the scope of the monitoring tag.

Figure 12:
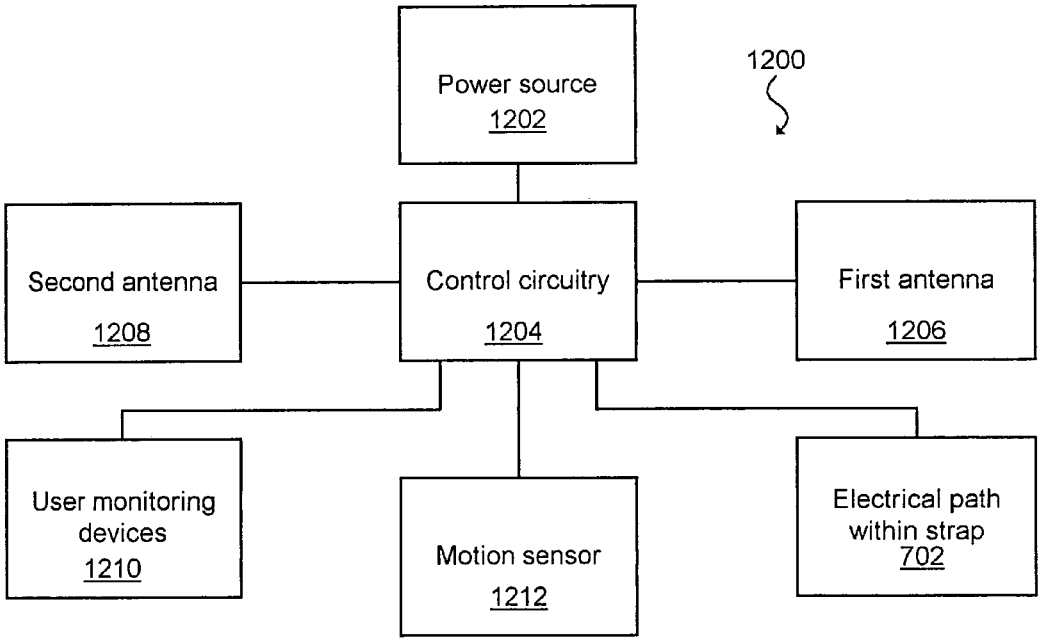
FIG. 12 is a block diagram illustrating interaction of the interior components of the monitoring tag of FIG. 1, in accordance with the second exemplary embodiment of the interior components.

FIG. 12 is a block diagram illustrating the interaction of the interior components 1200 of the monitoring tag 100 of FIG. 1, in accordance with the second exemplary embodiment of the interior components 1200. The second exemplary embodiment incorporates a motion sensor 1212 into the interior components 1200. The motion sensor 1212 can be a variety of types, for example but not limited to a piezoelectric, capacitance, null-balance, piezoresistive, or magnetic induction sensor. The motion sensor 1212 is within the housing 102 and coupled to the control circuitry 1204. The motion sensor 1212 allows the control circuitry 1204 to more efficiently use the resources of the monitoring tag 100. For example, if an individual wearing the monitoring tag 100 is sleeping, the monitoring tag 100 may be motionless for an extended period of time. When used with a monitoring station that uses the identification signal to trigger the activation of exit door locks, the monitoring tag 100 may not need to broadcast the identification signal during periods of time when the individual is asleep. By not broadcasting the identification signal during periods of rest, the power source 1202 of the monitoring tag 100 can be conserved, thus decreasing the required maintenance of the monitoring tag 100. The motion sensor 1212 may be sensitive to the slightest motion; for example, an individual being moved in a wheelchair can activate the motion sensor 1212. The first antenna 1206, second antenna 1208, monitor device 1210, and electrical path 702 of the second embodiment of interior components 1200 work similarly to that of the interior components 1100 of the first embodiment described above.

The tag 100 can be removed by an administrator transmitting a deactivation code to the tag 100. The deactivation code puts the tag 100 into a sleep mode. The monitoring system or a separate tester device can be used by the administrator to transmit the deactivation code. If the separate tester device is used, the tester device will also transmit a notification signal to the monitoring system to alert the monitoring system that the tag 100 is no longer in service. Once the tag 100 enters the sleep mode, the monitoring system or tester can be alerted by the tag 100 that the tag 100 has entered a sleep mode. This notifies the administrator and ensures that the tag 100 is in the sleep mode. The administrator then removes the tag 100 by removing the strap or by cutting the strap. Since the tag 100 is in sleep mode, the tag 100 will not alert the monitoring system. Several methods can be used to activate the tag 100 for the next intended use. One method automatically activates the tag 100 from sleep mode once a new strap 102 has been connected and the electrical path 702 closes the electrical circuit. Another method requires the monitoring system or tester device to transmit an activation code that causes the tag 100 to activate from the sleep mode.

It should be emphasized that the above-described embodiments of the present invention are merely possible examples of implementations merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A tag secured to an object for monitoring the object, comprising:

a strap with a first end, a second end, an electrical path coupled to the strap running from the first end to the second end, and one or more raised portions wherein a proximal end and a distal end of the electrical path are on the one or more raised portions;

a cradle that detachably couples the first end of the strap to the cradle and detachably couples the second end of the strap to the cradle; and an integrated circuit with a first contact and a second contact wherein the first contact electrically couples to the proximal end of the electrical path and the second contact electrically couples to the distal end of the electrical path.

2. The tag of claim 1, wherein the integrated circuit monitors one or more electrical properties of the electrical path and transmits a signal when the one or more electrical properties change.

3. The tag of claim 1, wherein the electrical path is thicker along portions of the strap that make contact with the cradle.

4. The tag of claim 1, wherein the electrical path is thicker along high stress portions of the strap.

5. The tag of claim 1, wherein both the proximal end and distal end of the electrical path are on the first end of the strap.

6. The tag of claim 1, wherein the integrated circuit is within a housing that detachably couples to the cradle and the first and second contacts protrude through openings in the bottom of the housing.

7. The tag of claim 6, wherein the cradle and the housing sandwich the strap.

8. The tag of claim 6, wherein a recessed portion of the cradle located on a surface between the housing and the cradle receives the first end of the strap.

9. The tag of claim 8, wherein the first end of the strap is narrower than the second end of the strap.

10. The tag of claim 7, wherein adhesive couples the first end of the strap to a surface of the cradle.

11. The tag of claim 7, wherein the cradle has a post and the first end of the strap has an opening to receive the post.

12. The tag of claim 1, wherein the cradle has a cinching mechanism that receives the second end of the strap.

13. The tag of claim 12, wherein the strap has two or more openings located lengthwise along the strap on the second end that engage the cinching mechanism.

14. The tag of claim 13, wherein the electrical path zigzags between the two or more openings located lengthwise along the strap on the second end.

15. The tag of claim 1, wherein the integrated circuit is within a housing with the first and second contacts protruding through openings in the bottom of the housing and the housing slidably couples to one or more rails on the cradle sandwiching the strap and the one or more raised portions and causing the first and second contacts to compress the one or more raised portions.

16. A tag secured to an object for monitoring the object, comprising:

a strap with a first end, a second end, and an electrical path coupled to the strap running from the first end of the strap to the second end of the strap;

a cradle that detachably couples the first end of the strap to the cradle and detachably couples the second end to the cradle;

an integrated circuit electrically coupled to a first end of the electrical path and a second end of the electrical path wherein the integrated circuit monitors one or more electrical properties of the electrical path; and a transmitter electrically coupled to the integrated circuit and the electrical path wherein the transmitter radiates a radio wave through the electrical path when the one or more electrical properties change, wherein the strap and electrical path have a break point at a location in which the length of the electrical path equals a multiple of the wavelength of a frequency of transmission.

17. The tag of claim 16, wherein the transmitter is electrically coupled to the integrated circuit, an antenna, and the electrical path wherein the transmitter radiates the radio wave through the antenna and the electrical path when the one or more electrical properties change.

18. The tag of claim 16, wherein the transmitter is electrically coupled to the integrated circuit, an antenna, and the electrical path wherein the transmitter radiates the radio wave through the antenna and the first end of the electrical path when the one or more electrical properties change.

19. The tag of claim 16, wherein the transmitter electrically coupled to the integrated circuit, an antenna, and the electrical path wherein the transmitter radiates the radio wave through the antenna and the first end and the second end of the electrical path when the one or more electrical properties change.

20. A tag secured to an object for monitoring the object comprising:

an object proximity detector;

a motion sensor for at least detecting motion and motionless states;

a transmitter in at least periodic communication with a monitoring system; and an integrated circuit in communication with the object proximity detector, the transmitter, and the motion sensor wherein the integrated circuit signals the monitoring system via the transmitter when the object proximity detector is separated from the object and wherein the integrated circuit substantially reduces communications from the transmitter when the motion sensor detects a motionless state for a period of time.

21. The tag of claim 20, wherein the integrated circuit increases power consumption of the tag by supplying power to the transmitter.

22. The tag of claim 20, wherein the integrated circuit increases power consumption of the tag by supplying power to the object proximity detector.

23. The tag of claim 20, wherein the integrated circuit increases power consumption of the tag by transmitting a periodic signal via the transmitter to the monitoring system.

* * * * *